United States Patent [19]

Soos

[11] 4,146,181

[45] Mar. 27, 1979

[54] GUARD RING FOR LAWN SPRINKLER HEAD

[76] Inventor: Steven W. Soos, 4120 Willowhead Way, Naples, Fla. 33940

[21] Appl. No.: 816,489

[22] Filed: Jul. 18, 1977

[51] Int. Cl.[2] ..... B05B 15/00

[52] U.S. Cl. ..... 239/288.5; 239/276

[58] Field of Search ..... 239/201, 276, 288, 288.3, 239/288.5; 137/377

[56] References Cited

U.S. PATENT DOCUMENTS

| | | | |
|---|---|---|---|
| 1,105,993 | 8/1914 | Munson | 239/201 UX |
| 2,484,794 | 10/1949 | Reuter | 239/276 X |
| 2,751,250 | 6/1956 | Block | 239/276 X |
| 3,265,310 | 8/1966 | Cohen | 239/201 |

*Primary Examiner*—Robert W. Saifer

[57] ABSTRACT

There is provided a guard ring for a lawn sprinkler head characterized by a sleeve dimensioned to surround at least the upper portion of a flush-type lawn sprinkler head. Extending outwardly and downwardly from the upper marginal edge of the sleeve is a frustoconical skirt. A plurality of ground engaging and stabilizing fins extending radially from the lower portion of the sleeve is also provided.

11 Claims, 2 Drawing Figures

GUARD RING FOR LAWN SPRINKLER HEAD

BACKGROUND OF THE INVENTION AND PRIOR ART

The invention relates as indicated to a guard ring for a flush-type lawn sprinkler head. Lawn sprinkling systems including an underground piping layout and a plurality of spaced lawn sprinkling heads are well known. Experience has shown that protection of the sprinkling heads from lawnmowers, and particularly rotary lawnmowers is necessary. A commonly employed guard ring is a cast concrete "doughnut" which serves as a protective collar. This requires the ground to be cut away around the sprinkler head to provide a recess for the doughnut so that the cap of the doughnut is close to ground level to permit lawnmower wheels etc. to roll over the doughnut. To overcome a tipping problem with the concrete doughnut protector, often times the upstanding pipe leading to the sprinkler head is surrounded with a concrete sleeve which rests well into the ground or on the horizontal pipe. This collar provided a base on which the concrete doughnut is seated without holddown means. In the absence of such a base, there is a tendency for the doughnut to tip as a lawnmower wheel passes thereover causing the trailing edge thereof to raise up and engage the reel or the rotor blades of the lawnmower with resulting damage to both. This problem is particularly evident in loose sandy soils such as are found in Florida.

U.S. Pat. No. 3,662,956 shows one form of sprinkler protector formed of concrete and having frustoconical sidewalls extending below ground level to the level of the underground feeder pipe. In order to prevent damage due to impact, as by a lawnmower wheel on the top of the sprinkler head, an underlying circumferential shoulder is provided in the protector to support the underside of the sprinkler head. Still other devices are known which are integral with the piping system for protecting a sprinkler head, such a pop-up type sprinkler head as shown in the patent to Trickey U.S. Pat. No. 3,404,840.

The present invention as compared to concrete doughnuts more readily accommodates and protects sprinkler heads which, after installation and perhaps after the sodding of the surrounding ground, or because of settling ground after installation, project somewhat above the ground level rather than being flush therewith. The flared skirt provides a ramp for the lawnmower and enables the wheel to more readily ride over a guard ring and thus minimizes the wheel obstruction and tipping or dislodging problems in using a guard ring to protect a sprinkler head which is somewhat above the level of the surrounding ground. Obviously, neither the guard ring or sprinkler head can be high enough to interfere with the passage of the reel or blade of a lawnmower over the ring and head.

The guard ring is preferably made of filled or unfilled plastic or similar material, e.g., pigmented polyethylene or pigmented polypropylene so that in the event one is tipped into or otherwise hits the blade or reel of a mower, little or no damage results to the mower.

The present invention provides a low cost guard ring which can be easily installed and is self-positioning with respect to ground level and which is constructed so that the guard ring may project a greater distance above the ground level than the conventional concrete doughnut and yet without creating an objectionable obstruction to lawn mower wheels and the like.

BRIEF STATEMENT OF THE INVENTION

Briefly stated, the present invention is in the provision of a guard ring for a lawn sprinkler head which is adapted to be pressed into the ground and which is characterized by a sleeve having upper and lower marginal edges. The sleeve is dimensioned to surround, preferably closely surround, the body of a flush-type sprinkler head, and to extend slightly above ground level. When in use, the lower portion of the sleeve extends below ground level and may optionally be tapered to facilitate pressing into the ground. Extending downwardly and outwardly from the upper marginal edge of the sleeve portion, there is provided a lip or skirt portion, preferably of a frustoconical configuration. To stabilize the guard ring against dislodgement from the ground, there is provided a plurality of radiating fins extending outwardly from the sleeve, and preferably extending axially below the lower marginal edge of the sleeve, and radially beyond the outer periphery of the skirt portion. In more specific embodiments of the invention, the fins are provided with a taper from a thin section at the lower marginal edges thereof to a wider section at the upper marginal edges thereof, the taper being from 1 to 5 degrees from the normal.

Reference may be had to U.S. Pat. No. 3,335,959 for a showing of a sprinkler head with which the guard ring of the present invention is particularly useful.

BRIEF DESCRIPTION OF THE DRAWINGS

The present invention may be better understood by having reference to the annexed drawings wherein.

DETAILED DESCRIPTION OF THE DRAWINGS

Figure 1:
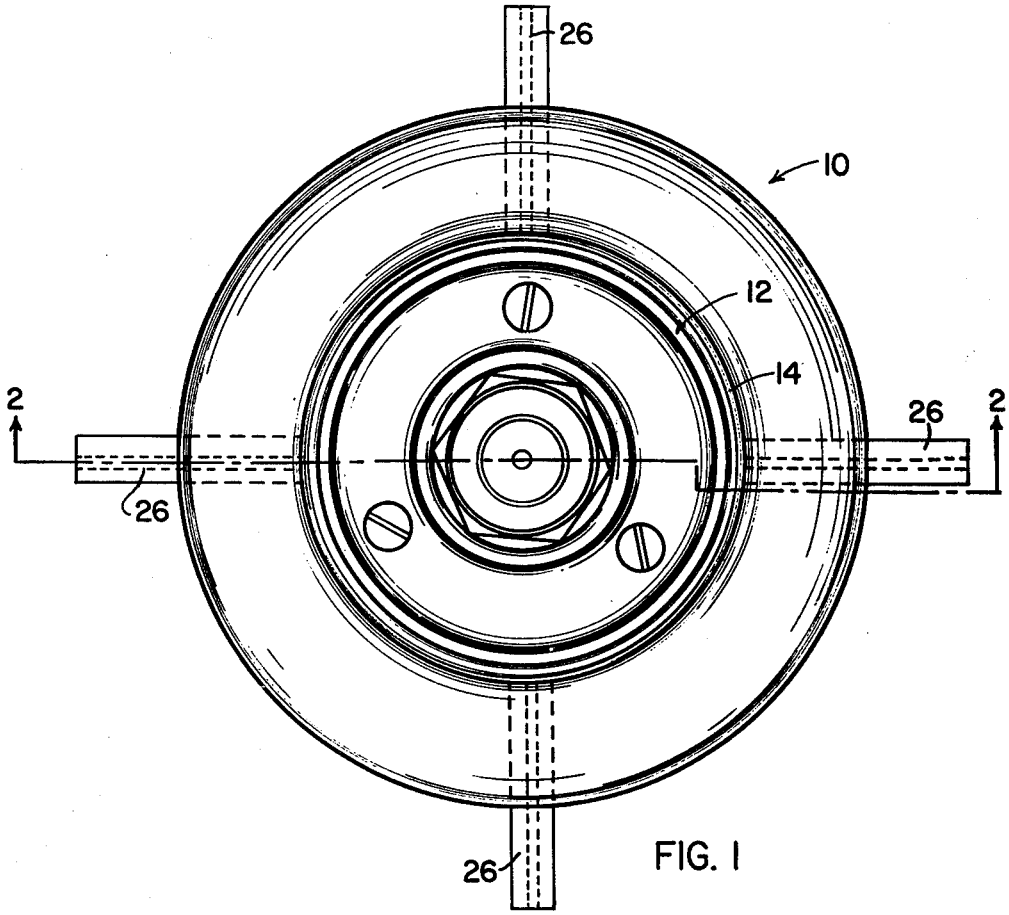
FIG. 1 is a top plan view of a ring guard in accordance with the present invention and showing the top of a flush-type sprinkler head surrounded by the ring guard.

Referring now more particularly to the drawings, there is here shown a ring guard 10 for a flush-type lawn sprinkler head generally indicated at 12. The sprinkler head, it will be understood, forms no part of the present invention. Other sprinkler heads may be used in combination with the ring guards of the present invention, the type shown being merely illustrative. The ring guards of the present invention are adapted to be pressed into the ground and are composed of a sleeve member 14 having an upper marginal edge 16 and a lower marginal edge 18, and being generally right cylindrical in geometric configuration. The sleeve 14 circumvallates the upper portion of the flush-type lawn sprinkler head which is desirably located at ground level indicated by the line 20 in FIG. 2. The sleeve 14 is adapted to be pressed into the ground concentrically with the riser pipe supplying the sprinkler head. The sidewalls of the sleeve 14 particularly near the lower edge 18, may be optionally tapered toward the lower edge 18 to facilitate insertion in the ground.

Figure 2:
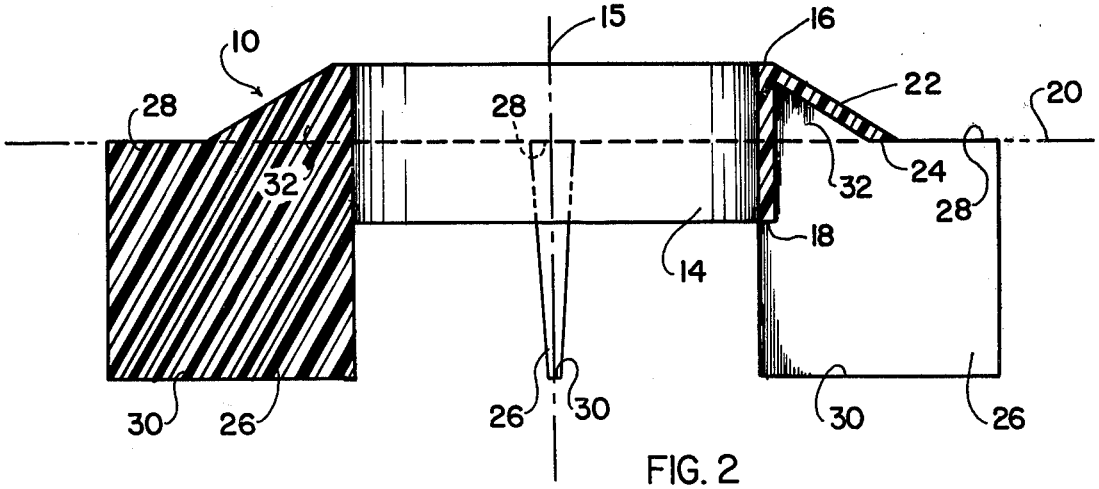
FIG. 2 is a cross sectional view of the ring guard shown in FIG. 1, omitting the sprinkler head, and as the ring guard would appear in the plane indicated by the lines 2—2 in FIG. 1.

Extending downwardly and outwardly from the outer circumference of the upper marginal edge 16 of the sleeve 14, is a skirt 22 desirably having a lower circular beveled edge 24 for seating on the ground level 20. As is best shown in FIG. 2, the lower marginal edge 24 of the flared skirt 22 lies in a plane which coincides with the ground level 20, which plane is intermediate the plane of the upper marginal edge 16, and the plane of the lower marginal edge 18. In the specific embodiment illustrated in FIG. 2, the plane of the lower marginal edge 24 of the skirt 22 is halfway between the plane of the upper marginal edge 16 and the plane of the lower marginal edge 18 of the sleeve 14. If desired, tapered points may project downwardly from the beveled edge 24.

In order to stabilize the ring against tipping, and against rotation about the vertical axis of the sprinkler head 12, there is provided a plurality of fins 26 which are integral with and extend outwardly, preferably radially outwardly, from the sleeve 14. The upper marginal edge 28 of each of the fins 26 conveniently lies in the plane including the lower marginal edge 24 of the skirt 22, and extends radially beyond the lower marginal edge 24. The lower marginal edge 30 of the fin 26 in the preferred embodiment lies in a plane normal to the central axis 15 of the guard ring 10, and axially spaced from and below the plane of the lower marginal edge 18 of the sleeve 14.

As best shown in FIG. 2, the fins 26 desirably have a tapered cross section, the extent of divergence in the direction from the lower marginal edge 30 to the upper marginal edge 28 being in the range of from 1° to 5° from the vertical. Not only does this aid in release of the object from a mold, but it also aids in insertion of the fins into the ground. The planar surfaces of the fins 26 may be optionally roughened.

Also as best shown in FIG. 2, the fins 26 are conveniently provided with an integral upwardly projecting rib portion 32 which is integral also with the sleeve 14 and the flared skirt 22. The rib portion 32 aids in stiffening the skirt portion 22 which, it will be appreciated, serves as a ramp for a lawnmower wheel when in place.

Although in the preferred embodiment shown in FIGS. 1 and 2, four radial fins 26 have been shown, fewer, although desirably not less than three, or more fins 26 than shown may be provided.

Other modes of applying the principles of the present invention may be employed, change being made as regards the details of structure shown and described above, provided the essential elements set forth in the annexed claims are utilized.

What is claimed is:

1. A guard ring for a lawn sprinkler head adapted to be pressed partly into the ground and comprising a sleeve having upper and lower marginal edges and adapted to surround a lawn sprinkler head, a flared skirt adapted to engage the ground at ground level to position said ring vertically relative to ground level and extending from the upper marginal portion of said sleeve outwardly and downwardly, and a plurality of fins adapted to be pressed into the ground and extending laterally outwardly from said sleeve beneath said skirt a distance greater than the outward extent of said flared skirt and downwardly from the underside of said skirt.

2. A guard ring in accordance with claim 1 wherein said flared skirt terminates at its free edge in a plane substantially normal to the axis of the sleeve and intermediate the upper and lower marginal edges of the sleeve for engagement with the ground at ground level.

3. A guard ring in accordance with claim 1 wherein said flared skirt has a frustoconnical upper surface.

4. A guard ring in accordance with claim 1 in which the sleeve is a right cylinder sleeve.

5. A guard ring in accordance with claim 4 wherein the fins extend radially outwardly.

6. A guard ring in accordance with claim 1 wherein the fins are located at 90° intervals about said sleeve.

7. A guard ring in accordance with claim 1 wherein the fins are wedge shaped.

8. A guard ring in accordance with claim 1 wherein each of said fins includes a rib portion extending as a continuation of the fins into the groove formed between the outside of the sleeve and the underside of the flared skirt.

9. A guard ring in accordance with claim 1 wherein the upper margin of the sleeve is an annular surface lying in a plane normal to the axis of the sleeve and the upper surface of the flared skirt extends from the outer circumference of said sleeve.

10. A guard ring for a lawn sprinkler head adapted to be pressed partly into the ground and comprising a sleeve having upper and lower marginal edges and adapted to surround a lawn sprinkler head, a flared skirt adapted to engage the ground at ground level to position said ring vertically relative to ground level and extending from the upper marginal portion of said sleeve outwardly and downwardly, and a plurality of fins adapted to be pressed into the ground and extending laterally outwardly from said sleeve beneath said skirt a distance greater than the outward extent of said flared skirt and downwardly from the underside of said skirt, said fins extending axially in the direction of said lower marginal edge of said sleeve a distance greater than the axial extent of said sleeve.

11. A guard ring for a lawn sprinkler head adapted to be pressed partly into the ground and comprising a body having a sleeve portion including upper and lower marginal edges, and a flared portion, said body being adapted to surround a lawn sprinkler head, when pressed into the ground, said flared portion including a sloped surface extending from the upper marginal edge of said sleeve portion downwardly and outwardly with the outer marginal edge of said sloped surface adapted to engage the ground at ground level, and a plurality of peripherally disposed fins extending outwardly from said sleeve portion and beyond the peripheral limits of said body in at least one direction.

* * * * *